US005193249A

United States Patent [19]

Bucher

[11] Patent Number: 5,193,249

[45] Date of Patent: Mar. 16, 1993

[54] HARDWARE FITTING

[75] Inventor: Albert G. Bucher, Masterton, New Zealand

[73] Assignee: Interlock Industries Limited, Wellington, New Zealand

[21] Appl. No.: 802,696

[22] Filed: Dec. 5, 1991

Related U.S. Application Data

[63] Continuation of Ser. No. 321,270, Mar. 9, 1989, abandoned.

[30] Foreign Application Priority Data

Mar. 9, 1988 [NL] Netherlands ..... 223803
Sep. 30, 1988 [NL] Netherlands ..... 226410

[51] Int. Cl.[5] ..... E05D 11/06; E05D 11/10
[52] U.S. Cl. ..... 16/371; 16/327
[58] Field of Search ..... 16/82, 366, 370, 371, 16/331, 327; 292/137

[56] References Cited

U.S. PATENT DOCUMENTS 699,301 5/1902 Fogel ..... 292/137
1,962,904 6/1934 Marple ..... 292/137
3,181,903 5/1965 Olander ..... 292/137

FOREIGN PATENT DOCUMENTS 2060799 6/1972 Fed. Rep. of Germany ..... 16/82

*Primary Examiner*—Robert L. Spruill
*Assistant Examiner*—Carmine Cuda
*Attorney, Agent, or Firm*—Oblon, Spivak, McClelland, Maier & Neustadt

[57] ABSTRACT

There is provided a hardware fitting of the type having a mounting and one or more movable components. There is provided a movable element with the mounting and one or more of the movable components of the fitting can engage with the movable element during at least part of the movement of the movable component(s). The or one of the movable components becomes locked as a result of interengagement of the engagement mechanism with the movable element during such part of the movement.

19 Claims, 4 Drawing Sheets

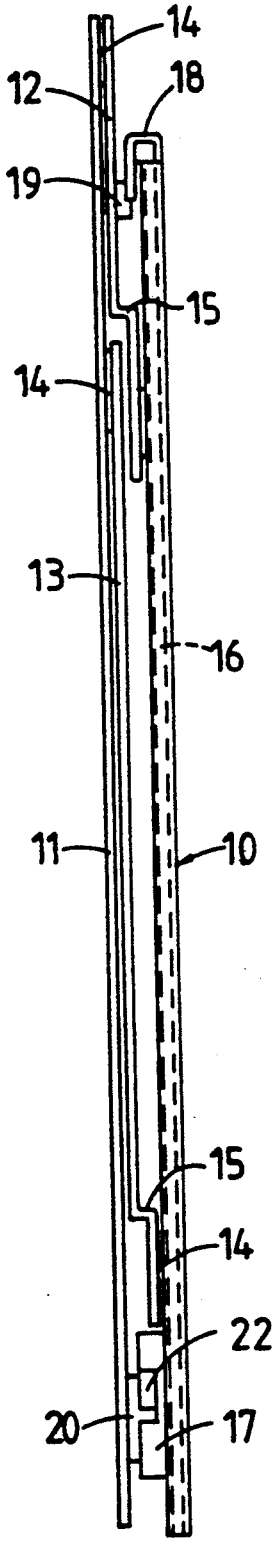
FIG. 2.
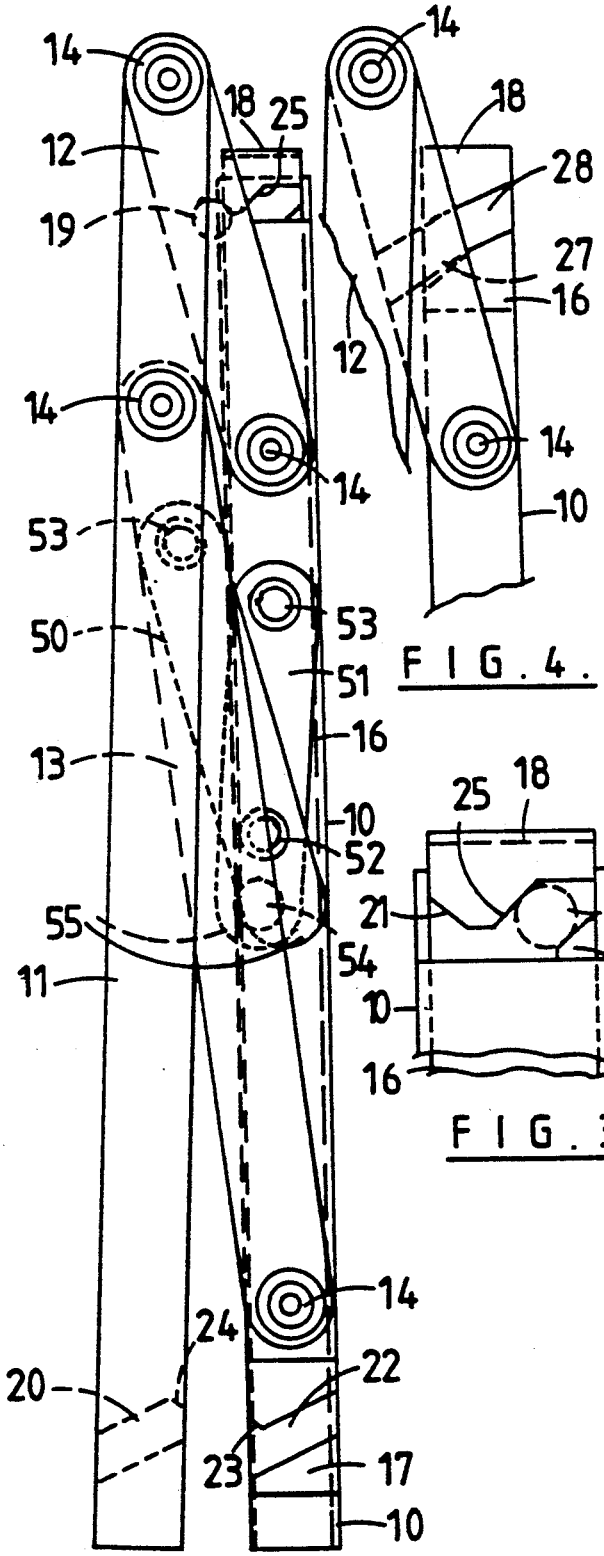
FIG. 1.
FIG. 4.
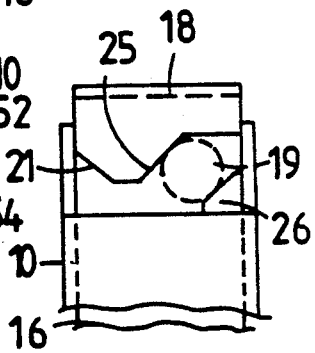
FIG. 3.

HARDWARE FITTING

This application is a continuation of application Ser. No. 07/321,270, filed on Mar. 9, 1989, now abandoned.

BACKGROUND OF THE DISCLOSURE

1. Field of the Invention

This invention relates to hardware fittings and more particularly to stays for the adjustable mounting of window sashes in window frames.

2. Discussion of the Background

A projected hung window sash is one which is mounted in a fixed window frame by at least a pair of stays. The window sash can be side hung with the stays situated at the top and bottom of the sash or it can be top hung with the stays located nearer the top edge of the sash. The sash is coupled to the frame via arms which conventionally are pivotally attached to mounting plates which themselves are fastened to the sash and frame. A well known form of window stay incorporates a pair of unequal length arms pivotally mounted at each end to frame and sash mounting plates. Such a stay is often referred to as a four bar stay. It is also known to provide six bar stays which are essentially a four bar stay with the inclusion of two additional arms. It is further known to provide such stays with one or more of the pivot points being slidable during all or part of the opening and closing of the stay.

Irrespective of their design or geometric configurations stays for projected hung windows provide a certain amount of "pull-in" at the final stages of closing of the sash. This pull-in effectively constitutes, relative to the plane of the frame, a sideways or transverse movement or component of movement so that not only is the portion of the sash opposite to that which will be internally latched moved into a fully closed position in the frame but usually ensures that weather seals with the frame or sash are compressed so as to provide an overall seal between the sash and frame. This pull-in can be provided by the actual geometry of the stay, by a sliding movement of one or more pivots or by a fixed guide with which part of the stay engages and imparts the sideways movement or component of movement.

Standards specification usually require that projected hung windows be able to resist opening in the event of negative pressures. This resistance to opening is in part provided by the internal latching of the sash (e.g. by a wedge lock), however, it is primarily the action of the stays which prevent that portion of the window sash opposite to which the internal fastening is attached from being sucked open.

In addition it is usually very difficult to provide a stay construction which achieves pull-in movement over the whole of the sash sufficient to ensure that entire compression of the weather seal takes place.

The aforementioned requirements and the difficulties associated with some stay constructions are compounded by present day demands that stays be able to fit within confined (more particularly narrow) cavities between the sash and frame.

SUMMARY OF THE INVENTION

While the present invention is particularly suited for hardware fittings in the form of window stays it also has application in other fittings having at least one movable component and a mounting. Thus while the description which follows relates to window stays the invention is not so limited and can relate to other pieces of hardware such a window/door closers, window fasteners and the like.

An object of the invention is to provide a hardware fitting which incorporates means for retaining a movable component relative to a mounting against movement when the movable component is in at least one position relative to the mounting.

Broadly speaking, one aspect the present invention consists of a hardware fitting characterised by a mounting having a movable element, there being engagement means with one or more movable components of the fitting which move relative to said mounting and which engage with said movable element during part of such movement so that the or one of the movable components becomes locked as a result of the interengagement of said engagement means with said movable element during said part of the movement.

A further object of the present invention is to provide a window stay which in use can achieve substantially overall pull-in of the sash and provide retention of the sash within the frame when the sash is in the closed position.

Broadly speaking, a second aspect the present invention consists of a window stay of the type having at least a pair of arms pivotally coupled between sash and frame mounting plates characterised in that at least one movable element is provided with one of the mounting plates, there being engagement means with one or more of the components of the stay which move relative to said one mounting plate and which engage with said moving element during final closing of the stay such that a component of movement of the stay transverse to said one mounting plate and retention of the stay in a closed position is effected by the interengagement of said engagement means with said movable element.

BRIEF DESCRIPTION OF THE DRAWINGS

In the following more detailed description of the invention according to preferred embodiments reference will be made to the accompanying drawings in which:

FIG. 1 is a plan view of one form of the stay at a point where it is commencing the final stages of closing, FIG. 2 is a side view of the stay as shown in FIG. 1, FIG. 3 is an enlarged view of the upper portion of the stay shown in FIG. 1, FIG. 4 is a partial view of the support portion of a modified form of the stay shown in FIG. 1.

DESCRIPTION OF THE PREFERRED EMBODIMENTS

In the following more detail description the stay construction as shown in FIGS. 1 to 4 is a conventional four bar construction having a pair of unequal length arms pivotally coupled at their respective ends to sash and frame mounting plates. The sash and frame mounting plates are provided with openings (not shown) whereby they can be attached to the frame and sash of the window. The arms are coupled to the mounting plates by pivot joints which are preferably friction pivot joints of a type disclosed in any one of New Zealand Patent Specifications 144922, 1621919, 196479, 195036, 202214, 212599 or 223073.

Figure 5:
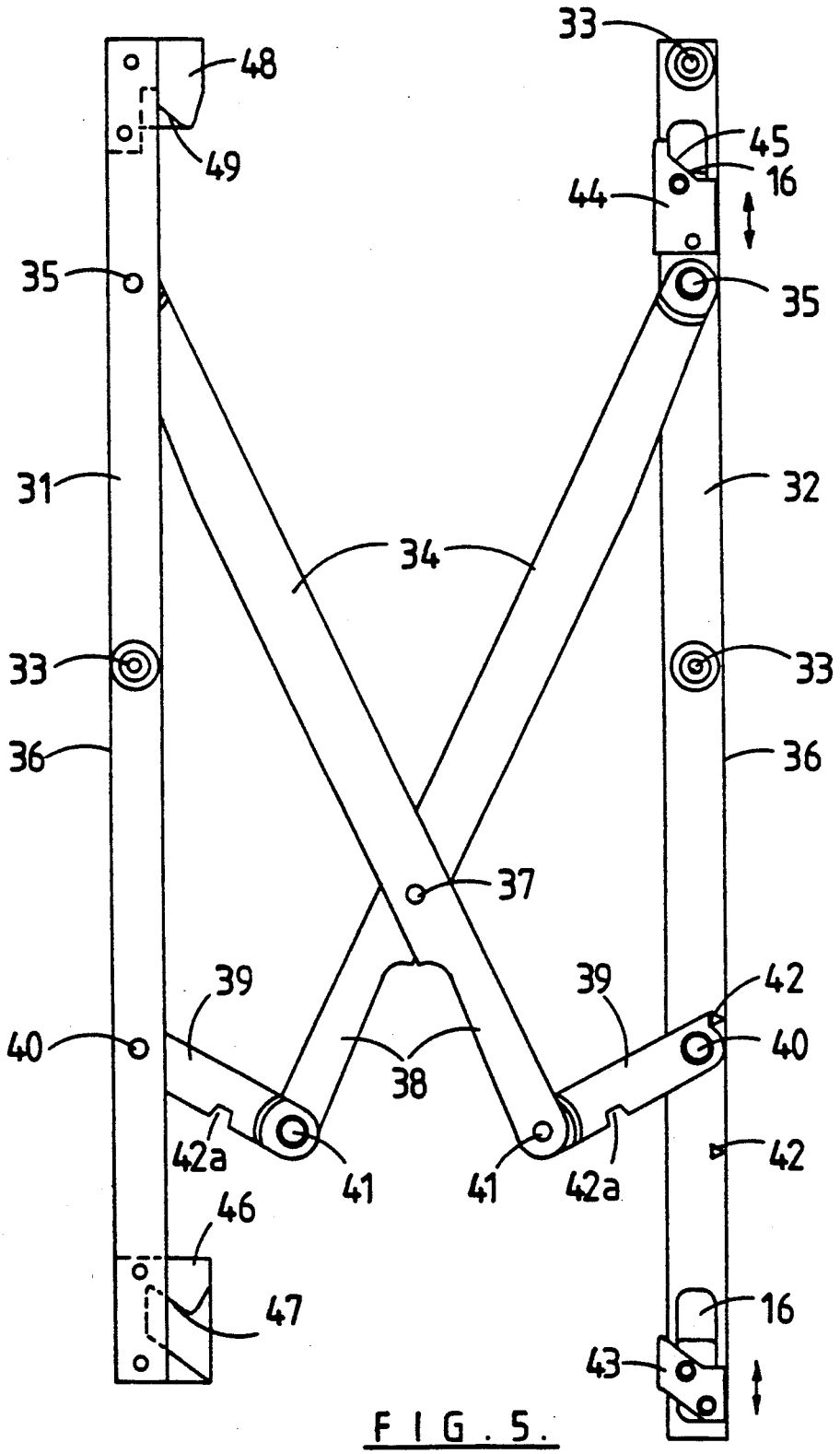
FIG. 5 is a plan view of a second form of window stay.
Figure 6:
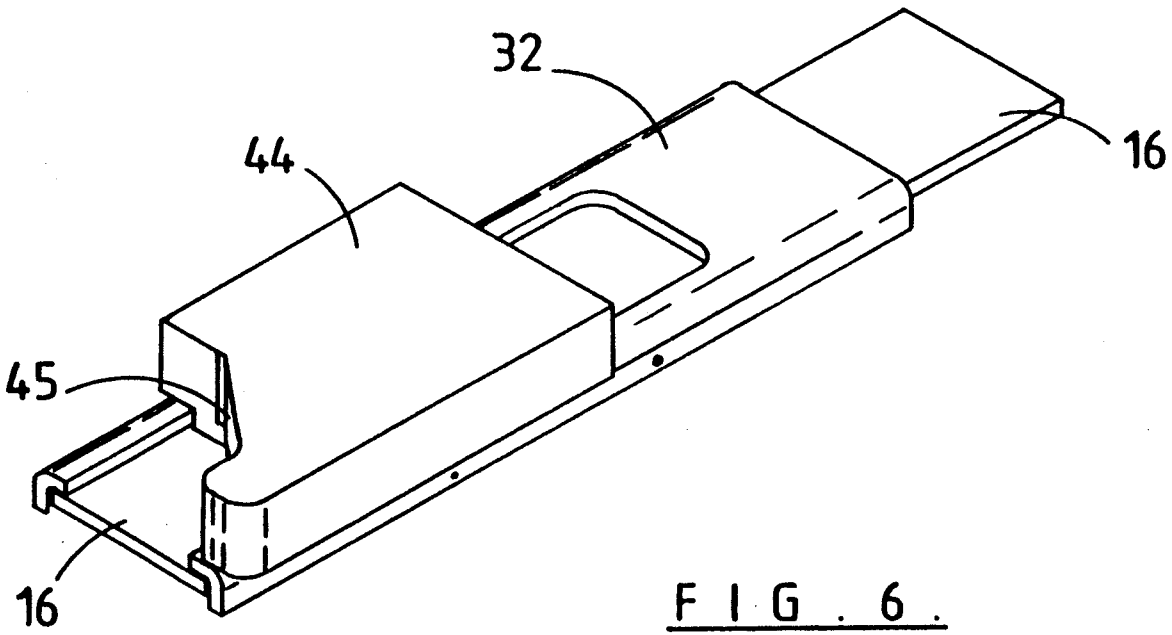
FIG. 6 is a perspective view of the top end of the right hand mounting plate of the stay shown in FIG. 5.

The stay shown in FIGS. 5 and 6 is a parallel action stay of the type disclosed in our New Zealand Patent Specification 219875.

The stay as illustrated in FIGS. 1 to 4 comprises a frame mounting plate 10 and a sash mounting plate 11 which are coupled together by a short arm 12 and a long arm 13 with the pivot joints being shown at 14. The mounting plates and arms are formed in accordance with conventional practice and arms 12 and 13 are cranked 15 at the ends thereof which couple with the frame mounting plate 10. The frame mounting plate 10 is of a thickness and construction such that a channel, recess or cavity extends the length thereof.

In the following description the stay as illustrated will be described as if in a vertical orientation such as when attached to a sash and frame in a projected side hung application.

Located within the mounting plate 10 is a plate 16 which is so located as to be longitudinally slidable. The lower end of sliding plate 16 is coupled to a slotted or bottom plate 17 which is located on the surface of mounting plate 10 and positioned just below the lower pivot 14 of arm 13. Coupled to the upper end of sliding plate 16 is a sliding pad 18 which as illustrated in FIG. 2 can be formed by the end of the sliding plate 16 which projects from the mounting plate 10 being bent back upon itself. It will be noted that a part of the surface of the mounting plate 10 has been removed in the vicinity of top pad 18. Located on arm 12 is a pin 19 while a projection or slider 20 is located near the lower end of sash mounting plate 11 and is located at an angle across the width of the mounting plate.

In order to complete a description of the construction of the stay reference will be made to the stay during operation at final closing.

As illustrated in FIG. 1 the pin 19, at the commencement of the final stages of closing, comes into contact with an inclined surface 21 of top pad 18. The interengagement of pin 19 and surface 21 causes the sliding plate 16 to move upwardly so that the slot 22 in bottom plate 17 is correctly positioned to permit entry therein of projection 20. If, for example, the sliding plate 16 should "drop" when the stay is in a top hung situation due to wear or loss of friction, pin 19 will reposition slider 16 in the correct operative position by means of the inclined surface 21. Preferably the leading portions of slot 22 and projection 20 are provided with inclined surfaces 23 and 24 respectively.

As the stay continues to close pin 19 continues to move across top pad 18 while projection 20 moves into slot 22.

The configuration and positioning of slot 22 and projection 20 is such that the projection engages the lower inclined surface of slot 22 and applies a downward sliding movement to plate 16 and pin 19 engages with and slides along surface 25 of top plate 18. This inclined surface 25 and the downward movement of the sliding plate 16 applies a transverse component of movement such as to provide a forced pull-in of the sash to the frame. In addition, however, the pin 19 becomes locked in plate by the presence of surface 25.

With the window sash latched closed by internal latches at or near the bottom of the sash the interengagement projection 20 and slot 22 prevents the sliding plate 16 from upward movement and thereby pin 19 is captured by surface 25 until such time as the window is unlatched and the sash pushed open. During opening of the sash the reverse procedure takes place as the sliding plate 16 is forced upwardly due to projection 20 slidingly engaging with the upper inclined surface of slot 22 which enables the pin 19 to be released and moved away from top pad 18.

At the top of plate 16 there is provided a ramp portion 26 which functions as a kick-out to prevent overtoggling during closing. Such an arrangement is, however, not required in the modified form illustrated in FIG. 4 wherein pin 19 is replaced by a top slider 27 which engages within a slot 28 of the top sliding pad 18.

The stay thus provides a construction whereby a positive and forced pull-in of the sash is provided not only at the end of the stay having the short arm but also toward the lower end of the frame mounting plate. This overall pull-in or forced action only occurs at pre-determined angles and relationships of the pivot 14, length of short arm 12, position of pin 19 and radiused action of the window flange. This action will, however, always be more than the actual seal compression (at least 5–10 mm forced movement). Additionally the short arm of the stay is locked when the lock is in the closed position thereby retaining that part of the sash which is prone to being sucked out in the event of negative pressures acting on the sash.

With the stay arrangement as described and illustrated, the last movement, upon closing, of the stay is essentially perpendicular to the plane of the frame. This therefore eliminates rubbing of seals or any sliding of seals leading to longer life thereof and better sealing.

FIG. 1 of the drawings also shows a pair of additional links 50 and 51 which can be incorporated in the stay. Link 50 is pivotally coupled at one end to the longer arm 13 while the other link 51 is pivotally coupled at one end to the frame mounting plate 10. As illustrated, the pivotal coupling of links 50 and 51 are spaced from adjacent pivots 14 coupling arms 13 and 12 to the mounting plates 11 and 10 respectively. The other end of the links 50 and 51 are coupled at or adjacent their ends by a pivot 52. Pivots 52 and 53 can be of a friction or non friction type.

These extra links 50 and 51 which work like scissors help to support the sash inside hung applications and adds more friction through the three additional bearings. This additional friction is in particularly significant when the stay is being used in a top hung configuration.

The stay is also capable of carrying greater capacity because of the one additional linkage in a conventional 4 bar stay arrangement. However, the ends of the links 50 and 51 coupled together by pivot 52 preferably overlap, i.e. extend beyond the pivot 52, and this overlap of the joint provides better support. This overhang can also be used to increase friction by placing a friction pad or plastic washer 54 on the extended portion 55 of one link so that this pad or washer 54 engages with the opposing surface of the other link either throughout the angular movement of one link relative to the other or when the extended portions 55 partially or completely overlap.

Referring now to FIGS. 5 and 6, a further form of window stay is illustrated.

FIGS. 5 and 6 of the accompanying drawing illustrates the window stay, when viewed in elevation in the fully open position. It will be appreciated that in the fully closed position the mounting plates lie substantially one over the other with the arms and link arms sandwiched therebetween.

The stay comprises first and second mounting plates 31, 32 which can each be of one or two pieces or section though for ease of fit and accuracy of centers, the one piece design as illustrated being preferred. The mounting plates 31 and 32 are coupled together by a pair of arms 34. Each arm 34 is coupled to the respective mounting plate 31 and 32 by a pivot joint 35 which is located at the end of the arm 34 and preferably at the end of the mounting plate. As can be seen in the drawing the pivot joint 35, and hence the axis thereof, is offset from the longitudinal centre line of the mounting plate. The offset is toward the outside edge 36 of the mounting plate.

The arms 34 are themselves joined together along their length by a pivot joint 37. This joint 37 is also offset relative to the longitudinal center line of the arms 34 and is positioned nearer to the ends of the mounting plates 31 and 32 having the pivot joints 35.

The other ends 38 of the arms 34 are each pivotally coupled to a link arm 39. The link arms 39 are pivotally coupled to the mounting plates 31 and 32 by pivot joints 40. Pivot joints 40 and the pivot joints 41 (coupling link arms 39 to arms 34) are offset, as shown in the drawing, to the respective center lines of the mounting plates and link arms.

Each mounting plate 31 and 32 has a pair of upstands 42 which form stops to limit the extent of movement of the link arms 39. These stops 42 define the fully open and closed positions of the stay. In the drawing the link arms 39 are shown as engaging stops 42 with the stay being in the fully open position. In the closed position the other stops 42 engage in recesses **42*a* in arms 39**.

The pivot joints 35, 37, 40 and 31 can either be simple pivots, friction bearings or a mixture of both types as aforesaid.

In the use of the stay the mounting plates 31 and 32 are mounted in a conventional manner to the opposite side edges of the respective window sash and window frame. Openings 33 are provided in the mounting plates 31 and 32 to permit the plates to be mounted by suitable mechanical fastenings. The sash is thus supported by the pair of stays in a position where it lies within and hence is substantially parallel to the frame. Thus as it is moved to and from the closed position in the frame the stays operate with an action that the sash moves parallel to the opening defined by the frame. The link arms 39 control the motion and allow for the change in depth of the scissor assembly without vertical movement of the sash relative to the frame. The stops 42 prevent "toggle over" of the link arms 39 at the closed position and to maintain the pull-in of the sash. Stops 42 also limit the extent to which the stay can "open" as illustrated in the drawing.

It will be appreciated that unlike conventionally mounted projected hung windows no side edge of the sash is substantially closer to the frame than any other at all open positions of the sash or during opening and closing of the sash. This action of the stay is unlike conventional scissor type stays as it is achieved without the need for sliding elements.

As with the first described embodiment a sliding plate 16 is located with one mounting plate. One end of the plate 16 carries a fixed element having a projecting tongue 43 while the other end carries a pad 44 having an inclined surface 45. The other mounting plate carries at one end a mounting 46 with a recess 47 and at the other end a projection 48 with an inclined surface 49. The sliding plate 16 can slide in the directions indicated by the arrows adjacent the ends of the mounting plate.

As the mounting plates approach one another, as a consequence of relative movement therebetween, tongue 43 enters recess 47 with the result that the sliding plate 16 moves up (as viewed in FIG. 5) which causes the inclined surface 45 of pad 44 to move behind inclined surface 49 of projection 48 so that, as with the previously described embodiments, there is forced pull-in of the sash to the frame. In addition a locking action as previously described, takes place.

When the window is opened a reverse action takes place. During this action the head of the window will be pushed out of the frame opening and will thus clear the seals in a controlled manner. There is normally a tendency for a window to push back against the seals. The mechanical advantage caused by the slider moving downward pushes the window out and ensures clearance of the seals takes place. Conventionally the seals are mounted with either the sash or frame.

Figure 7:
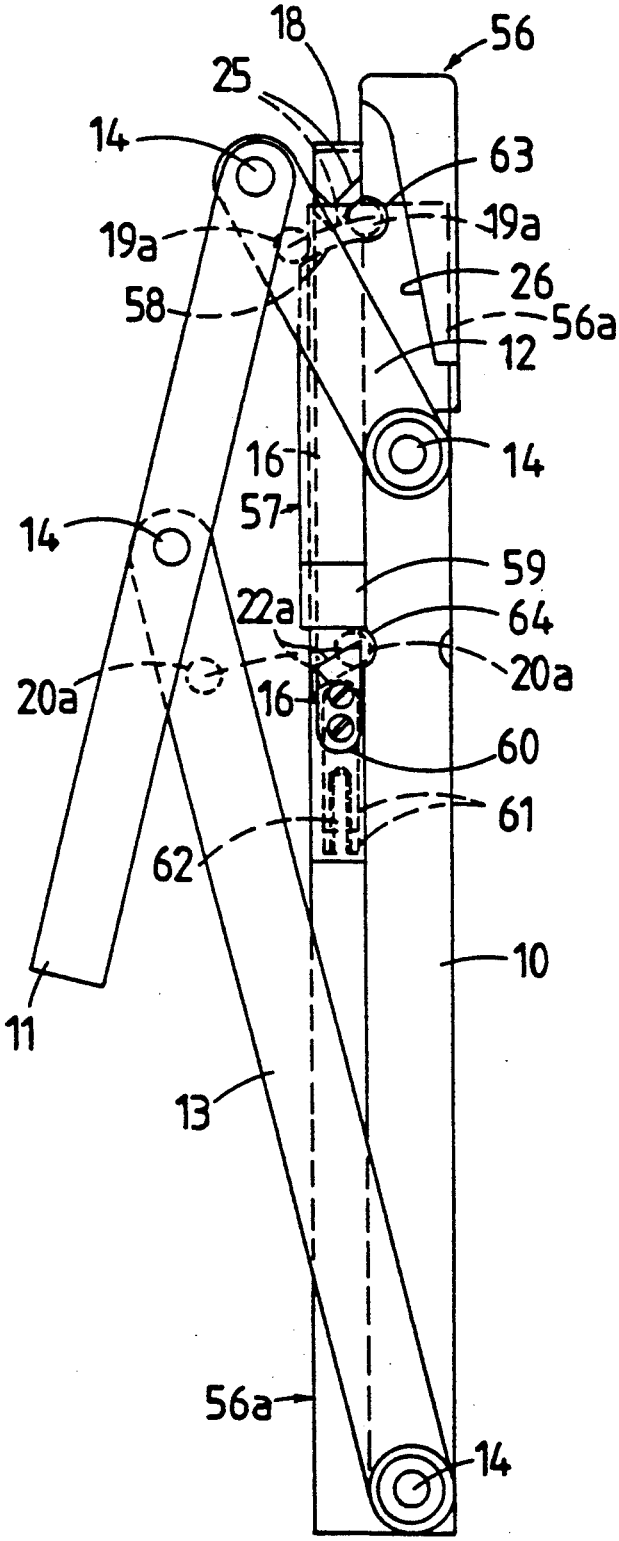
FIG. 7 is a plan view of a third form of window stay according to the invention.
Figure 8:
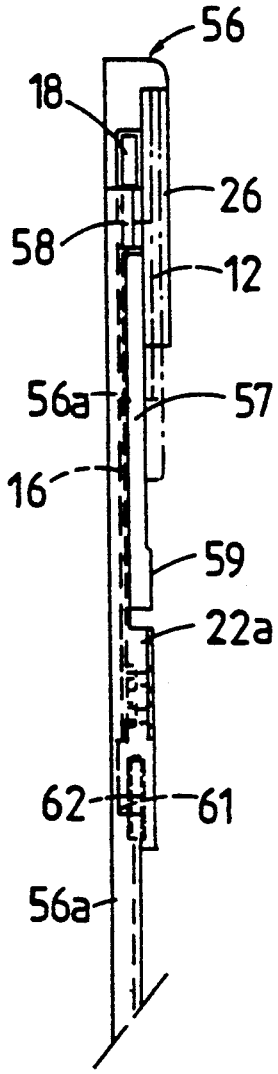
FIG. 8 is a partial side view of the stay as shown in FIG. 7.

In FIGS. 7 and 8 there is illustrated yet a further form of the invention. In these Figures elements of construction which correspond to those shown in FIGS. 1 to 4 bear the same reference numerals.

According to this form of the invention, the sliding plate 16 is slidingly located within a housing 56 which can be formed with or separate from the frame mounting plate 10. When formed separate to the frame mounting plate 10, the housing can be an "add-on" fitting for use with standard forms of window stays which are to be used in severe negative pressure situations. It is envisioned that the housing 56 can be moulded from a suitable plastics material. As illustrated, the housing 56 is located at one end (i.e. the upper end) of the mounting plate 10. Preferably a plate **56*a* is located beneath and extends the length of the mounting plate 10. This plate 56*a* is located beneath a channel portion 57 of housing 56 thereby forming a passage in which plate 16 locates and slides. Plate 56*a* can be profiled with a channel which interfits with channel portion 57**.

One end of the housing 57 forms a curved ramp 58. This elongated housing 57 can also incorporate a raised surface 59 which can engage during final closing of the stay (and initial opening of the stay) with the face surface of arm 13 so as to provide increased friction in the manner of the friction pad 54 and the extended portion 55 as illustrated in FIG. 1 of the drawings. Also raised surface 59 can form a stop which engages with arm 12 to limit the extent of opening of the stay.

In a similar arrangement to that shown in FIG. 5, the lower end of plate 16 carries a projection 60 which incorporates an inclined surface **22*a***.

Extending from projection 60 is a tongue 61 which is engaged with or houses one end of a spring 62. The other end of the spring 62 is fixed relative to the fixed plate **56*a***.

To further describe the arrangement illustrated in FIGS. 7 and 8 reference will be made to the operation of the stay. During final closing of the stay a projection **20*a* carried by arm 13 comes into engagement with the ramp formed by inclined surface 22*a*. Simultaneously projection 19*a* of arm 12 moves across the curved surface 58. The interengagement of projection 20*a* and ramp 22*a* causes the projection 60 to move downwardly relative to mounting plate 10 thereby causing longitudinal sliding movement of plate 16** to take place.

When projection 20*a* has reached its final position (as shown in dotted detail in FIG. 7), the ramp 22*a* has moved to the position shown in dotted detail and top pad 18 will have moved into the position also shown in dotted detail where projection 19*a* is located and retained at the end of curved surface 58. Preferably a recess 63 is provided to accommodate pin 19*a*. Likewise a recess 64 can be provided in mounting plate 10 to accommodate pin 20*a*.

Surface 25 of top pad 18 as with the previous embodiments engages with pin 19*a* to not only retain it in position and thereby lock the stay in the closed position, but also imparts a definite transverse movement to pin 19*a* thereby achieving the required pull-in at the final stages of closing of the stay.

As with the previously described embodiments, the window can be opened by unlatching the internal latch and pushing on the sash so that initial opening causes pin 20*a* to move out of recess 64. Due to the spring biassing provided by spring 62, the projection 60 is pushed upward so that sliding plate 16 is caused to slide thereby releasing pin 19*a* so that the top or shorter arm 12 of the stay is thereby free to move to facilitate opening of the window sash.

One advantage of this form of the invention is that more force is available for activation of the locking arrangement due to the longer leverage achieved by the positioning of pin 20*a* and ramp 22*a*. In addition the locking arrangement is more compact as the sliding plate only extends for part of the length of the mounting plate 10. This also achieves an economical construction. Finally, as mentioned previously, this arrangement can be provided as an "add-on" for use with existing window stays.

Obviously, numerous modifications and variations of the present invention are possible in light of the above teachings. It is therefore to be understood that within the scope of the appended claims, the invention may be practiced otherwise than as specifically described herein.

I claim:

1. A hardware fitting which comprises:

a mounting, a movable element operatively associated with said mounting and being movable along a line of movement relative to the mounting, a component which is movable relative to the mounting, said movable component having engagement means which, during part of the movement of said movable component relative to said mounting, is engageable with a part of said movable element to thereby cause movement of said movable element along said line of movement, the movable element including means for cooperating with the movable component upon said movement of the movable element occurring so as to latch with said movable component, said cooperating means being spaced from said part of the movable element along said line of movement, said cooperating means unlatching the movable component upon reverse relative movement between the movable element and said mounting for causing said engagement means to impart a reverse movement of the movable element along said line of movement.

2. A hardware fitting as claimed in claim 1, wherein the cooperating means includes a first engagement surface which is engageable with the movable component whereby said reverse movement of the movable element along said line of movement occurs prior to the engagement means engaging with said movable element.

3. A hardware fitting as claimed in claim 1, wherein said cooperating means includes a second engagement surface and the movable component includes follower means for engaging with said first and second engagement surfaces, the second engagement surface being so configured such that upon engagement with said follower means a component of movement transverse to said line of movement is imparted to said movable component.

4. A hardware fitting as claimed in claim 2, wherein said cooperating means includes a second engagement surface and the movable component includes follower means for engaging with said first and second engagement surfaces, the second engagement surface being so configured such that upon engagement with said follower means a component of movement transverse to said line of movement is imparted to said movable component.

5. A hardware fitting as claimed in claim 3, wherein said movable element includes a surface which is engageable with said engagement means to thereby effect movement of said movable element along said line of movement.

6. A hardware fitting as claimed in claim 5, wherein the movable element comprises a plate which is mounted with said mounting for sliding movement along said line of movement, said engagement surface being inclined relative to the direction of sliding movement of said plate, and said engagement means, upon coming into sliding engagement with said surface, causing movement of said plate to take place.

7. A hardware fitting as claimed in claim 6, wherein the cooperating means is located on said plate at a spaced apart position relative to said engagement surface, and wherein said cooperating means comprises a latch which latches with said follower means of the movable component.

8. A hardware fitting, which comprises an elongate mounting, a plate operatively associated with said elongate mounting and being longitudinally movably mounted relative to said mounting, first and second components pivotally coupled to said mounting, a third component pivotally coupled with said first and second components whereby relative movement between said first, second and third components and said mounting can occur such that said third component is movable to a position so as to be located substantially over said elongate mounting, one of said movable components having engagement means which is engageable with said movable element as said third component moves towards said overlying position to thereby impart longitudinal sliding movement to said plate relative to said mounting, said plate including a latch member which is engageable with follower means associated with one of said movable components such that a component of movement of the third member transverse to said elongate mounting and retention of one of said movable components is brought about by the latch member and follower means engaging as a result to the interengagement of the engagement means with said movable element, the plate being slidingly movable in a reverse direction during movement of the third component away from the overlying position and said opposite sliding movement causing said follower means to move free of said latch.

9. A hardware fitting as claimed in claim 8, wherein said plate includes at least one inclined surface which is engageable with said engagement means to impart said longitudinal sliding movement of the plate.

10. A hardware fitting as claimed in claim 9, wherein said engagement means comprises a projection carried by said third movable component and wherein the follower means is carried by one of the said first and second movable components.

11. A hardward fitting as claimed in claim 9, wherein said engagement means comprises a projection carried by said third movable component, and said follower means is carried by said third component.

12. A hardware fitting as claimed in claim 9 which comprises biasing means for causing sliding movement of the plate in an opposite direction to that in which the plate moves during movement of the third movable component to the overlying position, said biasing means effecting release of said follower means from said latch.

13. A hardware fitting as claimed in claim 8 wherein each of said first and second movable components are pivotally coupled together and each of said first and second movable components are pivotally coupled to fourth and fifth movable components, respectively, said fourth and fifth movable components being pivotally coupled to said mounting and said third movable component.

14. A hardware fitting, which comprises:

an elongate mounting, a plate slidingly associated with said elongate mounting, at least one movable component which is movable toward and away from said elongate mounting, engagement means located with said at least one movable component and engageable with at least one engagement surface with the plate upon the at least one movable component moving toward said elongate mounting, the engagement between said engagement means and said engagement surface causing sliding movement of said plate to occur, said plate including latch means at a location spaced from said engagement surface, the at least one movable component having follower means engageable with said latch means and retained by said latch means upon completion of said sliding movement.

15. A hardware fitting which comprises:

a mounting, a movable element operatively associated with said mounting and being movable along a line of movement relative to the mounting, a first component which is movable relative to the mounting, said first movable component having engagement means which, during part of the movement thereof relative to said mounting, is engageable with a part of said movable element to thereby cause movement of said movable element along said line of movement, said movable element including means for cooperating with a second movable component upon said movement of the movable element occurring so as to latch with said second movable component, said cooperating means being spaced from said part of the movable element along said line of movement, said cooperating means unlatching the second movable component upon reverse relative movement between the movable element and said mounting for causing said engagement means to impart a reverse movement of the movable element along said line of movement wherein the cooperating means include a first engagement surface which is engageable with the second movable component whereby said reverse movement of the movable element along said line of movement occurs prior to the engagement means engaging with said movable element.

16. A hardware fitting as claimed in claim 15, wherein said cooperating means includes a second engagement surface and the second movable component includes follower means for engaging with said first and second engagement surfaces, the second engagement surface being so configured such that upon engagement with said follower means a component of movement transverse to said line of movement is imparted to said second movable component.

17. A hardware fitting as claimed in claim 16, wherein said movable element includes a surface which is engageable with said engagement means to thereby effect movement of said movable element along said line of movement.

18. A hardware fitting as claimed in claim 17, wherein the movable element comprises a plate which is mounted with said mounting for sliding movement along said line of movement, said engagement surface being inclined relative to the direction of sliding movement of said plate, and said engagement means, upon coming into sliding engagement with said surface, causing movement of said plate to take place.

19. A hardware fitting as claimed in claim 15, wherein the cooperating means is located on said plate at a spaced apart position relative to said engagement surface, and wherein said cooperating means comprises a latch which latches with said follower means of the second movable component.

* * * * *